US006003186A

United States Patent [19]

Larson

[11] Patent Number: 6,003,186

[45] Date of Patent: Dec. 21, 1999

[54] CYLINDRICAL BRUSH FOR A SWEEPING MACHINE

[75] Inventor: Warren L. Larson, Maple Grove, Minn.

[73] Assignee: Tennant Company, Golden Valley, Minn.

[21] Appl. No.: 08/800,544

[22] Filed: Feb. 18, 1997

[51] Int. Cl.[6] ..... A46B 9/02

[52] U.S. Cl. ..... 15/82; 15/52.1; 15/182

[58] Field of Search ..... 15/50.3, 52.1, 15/82, 83, 179, 182, 183, 340.3, 374, 383

[56] References Cited

U.S. PATENT DOCUMENTS

| | | | |
|---|---|---|---|
| 3,284,830 | 11/1966 | Kroll | 15/52.1 |
| 3,702,488 | 11/1972 | Kasper | 15/83 |
| 3,930,277 | 1/1976 | Wulff | 15/83 |
| 5,261,141 | 11/1993 | La Boda | 15/83 |

FOREIGN PATENT DOCUMENTS

| | | | |
|---|---|---|---|
| 1093323 | 11/1960 | Germany | 15/183 |

*Primary Examiner*—Terrence R. Till

*Attorney, Agent, or Firm*—Schwegman, Lundberg, Woessner and Kluth, P.A.

[57] ABSTRACT

A sweeping machine for picking up debris from a surface includes a frame and wheels attached to said frame to support the frame of the sweeping machine over the surface being swept. A cylindrical brush is rotatably attached to said frame. The cylindrical brush includes a pattern of rows of sweeping material having N sections that have a first spiral in a first direction and N+1 sections of the brush that have a second spiral in a second direction. Two of the N+1 sections having the second spiral are located on the ends of the brush. The spiral is selected so that it augers or moves debris from a desired or selected side of the sweeping machine toward the center of the brush. The sweeping machine also includes a mechanism for rotating said cylindrical brush.

5 Claims, 3 Drawing Sheets

CYLINDRICAL BRUSH FOR A SWEEPING MACHINE

FIELD OF THE INVENTION

The present invention relates to the field of sweeping machines. More particularly, this invention relates to a brush for a sweeping machine for picking up various types of debris from a surface being swept.

BACKGROUND OF THE INVENTION

There are many types of sweeping machines for removing various types of debris from a surface, such as the ground, a floor or a parking lot. Many of these sweeping machines use a rotating cylindrical brush to contact the surface being swept. The rotating cylindrical brush is used to lift various types of debris from the floor or surface and throw it into a debris hopper located near the rotating cylindrical brush. The machine moves the rotating cylindrical brush over the surface being swept. The rotational velocity of the cylindrical brush produces a velocity at the ends of the brush that differs from the velocity of the machine as it moves over the surface being swept. The brush can be rotated in either direction. There are many types of sweepers. Two types of sweepers are forward throw sweeper and indirect throw sweepers. Forward throw sweepers use a brush rotated backward with respect to the travel of the sweeping. The debris is thrown forward and collected in a container which is forward of the brush. Indirect throw or over-the-top sweepers use a brush rotated in either direction with a debris container located for collection of the debris.

Sweeping machines are used in a variety of environments. For example, some sweeping machines remove debris from roads and streets. Others are used to remove debris from parking lots and others are used to remove debris from factory floors. In short, there are many applications for sweeping machines. Sweeping machines also remove different types of debris. Certain brush designs can be employed to enhance a sweeping machine's ability to pick up or remove certain types of debris.

There are several types of brush fill patterns which are customarily used. One predominant type of brush fill pattern is termed full fill or high density. In a full fill type brush the bristles or other sweeping material are closely packed together or in a highly dense configuration. The bristles or other sweeping material of a full fill brush can be placed in almost any type of pattern to form a full fill type brush. The full fill brush presents a substantially solid mass of bristles or other sweeping material. Full fill type brushes are generally effective in removing relatively thin layers of fine material from surfaces being swept. Fine materials, also referred to as fines, include very fine particles, such as sands which are used in foundries for making molds, cement dust, and sand found in parking lots or in streets.

A second predominant type of brush fill pattern has spaces between rows of bristles or other sweeping material. This second type of brush has a number of variations. For example, a brush called a double row brush has two rows of closely spaced bristles or other sweeping material. This is called a double row. There is a larger space between each double row of bristles or other sweeping material. This second type of brush fill pattern is better for removing bulkier debris or deeper layers of fine material.

The second predominant type of brush fill pattern is formed by placing the bristles or other sweeping material in one of several patterns. One pattern is to place the bristles or other sweeping material in straight lines along the brush tube. The straight lines are substantially parallel to the axis of the brush tube. Brushes with straight line pattern of bristles or other sweeping material and spaces between the straight bristles or other sweeping material cause a brush to bounce or jump excessively because as the brush rotates, the brush alternates between having all the bristles or other sweeping material in one row of the brush in contact with the surface being swept and no bristles in contact with the surface being swept. The result of brush bounce is chatter lines of fine debris being left on the surface that has been swept. Brush bounce may also cause vibration of the sweeping machine.

To prevent the brush from bouncing, the rows of bristles are placed in spiral patterns along the surface of the brush tube. The spiral pattern has a number of spiral tufts placed in a pattern with spaces between the spiral pattern of tufts of sweeping material. When the tufts and spaces are in a spiral pattern, the amount of brush material in contact with the surface being swept is substantially constant as the brush rotates so as to minimize the amount of brush bounce. In other words, at any rotational position of the brush, there is always some brush fill material in contact with the surface being swept to support the brush as it rotates. Spiral pattern brushes also have a problem. Debris or fines may travel along the length of the brush. The spiral pattern having spaces between the spirals acts as an auger that may move the debris or fines in one direction along the surface of the brush. This can be a disadvantage since some debris or fines may be augured out at one end of the brush.

To prevent fines and debris from traveling along the length of the brush, many brush designs use a single or double herringbone pattern to break up the auguring effect. The herringbone pattern may also be termed a chevron pattern or may be termed as alternating spirals. These herringbone patterns prevent the migration of debris and material being swept from being augured down the length of the brush. The herringbone pattern allows material being swept to only travel to the point where the spiral changes directions. As a result, these types of brushes are more effective at sweeping up certain types of debris and preventing the auguring along the entire length of the brush during rotation.

Herringbone type brushes do auger debris a certain length. The herringbone patterns can be thought of as using one full chevron or a multiple of one full chevron. One full chevron will have a first spiral in a first direction and a second spiral in a second direction. Brushes which do use the herringbone patterns auger debris along the length of the spiral until the spiral changes directions. The problem with a pattern of brush which has a number of full chevrons or an the same number of different direction spirals is that at both ends of the cylindrical brush, the debris or material being swept will be either augured outward or inward from the end of the cylindrical brush. The direction of auguring is dependent on the orientation of the chevrons with respect to the rotational direction of the brush. It is desirable to rotate the brush so that the debris and fines auger toward the middle of the brush. However, if the chevrons on the brush are always oriented one way, the bristles or brush material forming the brush can take a set. In other words, like a push broom, the bristles or brush material can bend over and become less effective. To prolong the life of a cylindrical brush, regular maintenance requires that the brush be switched or flipped end to end to change the orientation of the chevrons and prevent the bristles or other sweeping material or brush fill material from taking a set in one direction. Flipping the brush end to end changes the direction of the force on the tufts or bristles of the brush. When flipped or switched, the chevrons of the cylindrical brush will auger debris toward both ends of the brush which increases the possibility of trailing. Trailing is where some amount of debris or fines is left at the ends of the brush after the sweeping machine has passed.

Auguring of fines or other debris is troublesome when you consider that many times much of the debris is located on one end of the brush. For example, in streets it has been found that the vast majority of the debris and fines are located on one end of the brush, mainly near the curb and in the gutter. In this instance, there is a need for a cylindrical brush for use on a sweeping machine that will auger the fines or other debris inward toward the center of the brush while it is rotating no matter what orientation of the brush fill pattern of the cylindrical brush. There is also a need for a cylindrical brush that will prevent the material being swept from traveling along the entire length of the brush. There is also a need for a brush that will auger the debris or fines being swept in toward the center of the brush from a selected or desired side of a sweeping machine even when the brush is flipped end-for-end and the brush fill material is re-orientated. For example, it is necessary to have a brush that will auger the material being swept inward despite whether it is in a first orientation or whether it has been flipped end-to-end to a second orientation for maintenance purposes. There is also a need for a sweeping brush that will consistently pick up varying types of debris on a variety of surfaces and one that limits axial migration of debris toward the ends of a rotating cylindrical brush. There is also a need for a brush that minimizes trailing. There is a further need for a sweeping machine that is smooth and stable during its operation.

SUMMARY OF THE INVENTION

A rotatable cylindrical brush for a sweeping machine includes a tube having sweeping material or brush fill material attached to the core or brush tube. The sweeping material extends radially outward from the surface of said core or brush tube. The sweeping material forms a plurality rows. A row has a first spiral section in a first direction located on one end of the core and a third spiral section in a first direction located on the other end of the core. A second spiral section spiraling in a second direction is located intermediate the first and third spiral sections at the ends of the core or brush tube. As mentioned, there is more than one row. The rows are spaced from one another so that the space forms a similar pattern. The brush can also be thought of as having a plurality of sections having a plurality of rows. The brush includes n+1 spiral sections in a first direction, and n spirals in a second direction. The rows on the brush can also be thought of as forming a "V" or chevron pattern with an additional spiral attached to the end of a full "V" or chevron. The spiral sections at the end of the brush are oriented so that one selected or desired end of the brush augers debris in toward the middle of the brush.

Advantageously, as the debris is augured inward from a selected or desired end, the debris is restricted in its travel along the length of the cylindrical body of the brush. The debris is also moved from the desired or selected end of the brush for effective sweeping with minimized trailing or debris at the desired or selected end of the cylindrical brush. The brush can also be flipped end-to-end thereby re-orientating the brush fill pattern and the bristles with respect to the surface being swept. After being flipped, the brush will still auger debris inward from a desired or selected side of the sweeping machine. An additional advantage is that a sweeping machine equipped with the cylindrical brush mentioned above picks up or sweeps all types of debris.

DESCRIPTION OF THE PREFERRED EMBODIMENT

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

Figure 1:
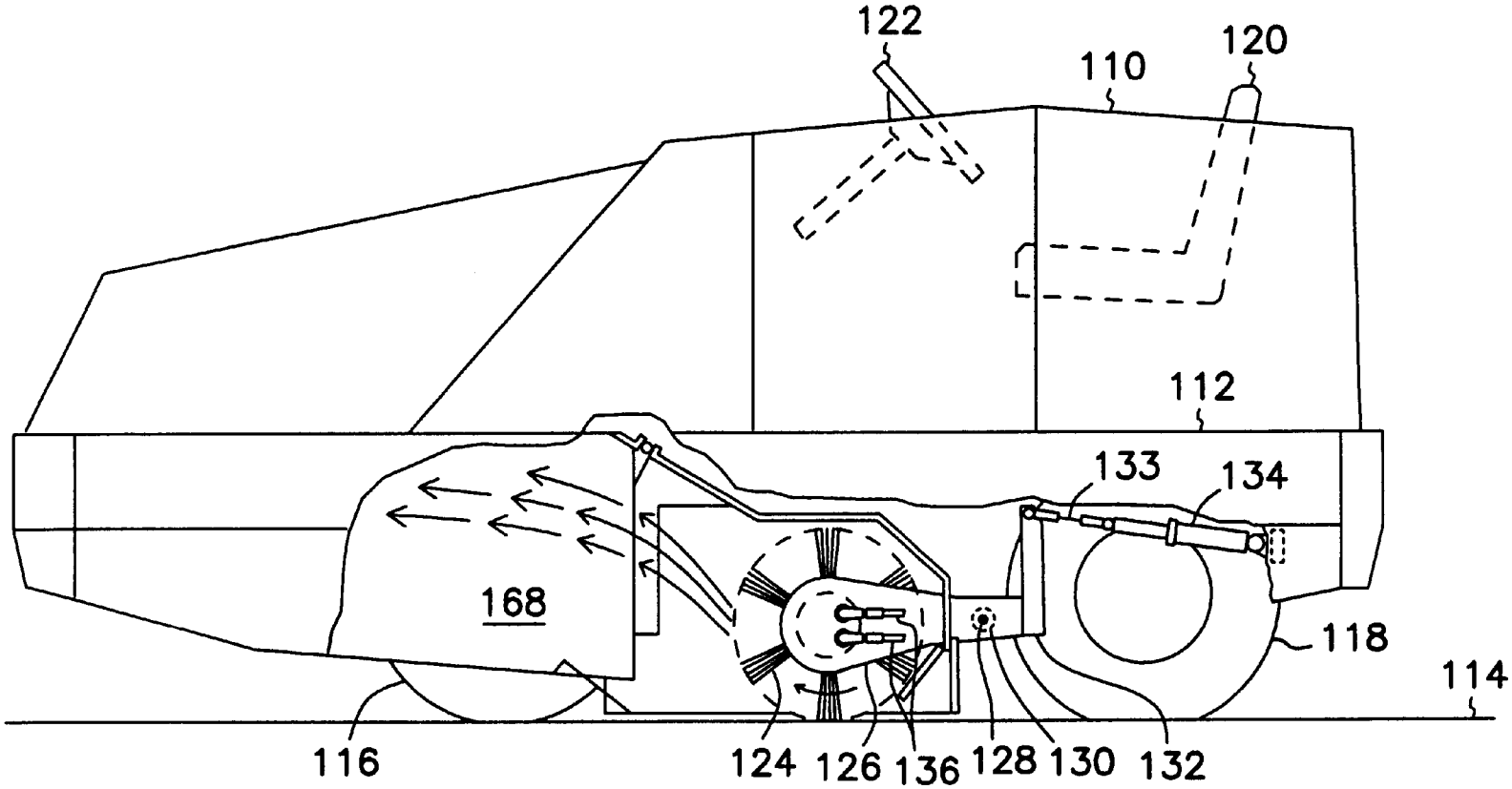
FIG. 1 is a side view of the sweeping machine.

FIG. 1 is a side view of a forward throw type sweeping machine which uses a preferred embodiment of the present invention. It should be noted that the brush can be used on any type of sweeping machine and that the one shown in FIG. 1 is for the purpose of illustration. The sweeper 110 has a frame 112 and is supported on a surface to be swept 114 by two free rolling front wheels 116 (only one shown) and one steerable, powered rear wheel 118. Provisions for a driver are indicated generally by a seat 120 and a steering wheel 122. Other conventional controls are also provided, but are not shown.

A cylindrical sweeping brush 124, is mounted in a conventional manner and extends across most of the transverse width of the sweeping machine. It is supported between two brush arms 126 (only one shown) which are attached in pivotal manner to the sides of the frame 112 at two transversely aligned points 128 (only one shown). A cross shaft 130 joins the two brush arms 126 together so that both ends of brush 124 are maintained in alignment. A lift arm 132 is welded or otherwise attached to one brush arm, and is pivotally connected at its upper end to a cable assembly 133. This connects to a hydraulic cylinder 134 which is used to raise the brush 124 off the surface 114 for transport, or lowered to its working position as shown in FIG. 1. In working position, cable assembly 133 may be slack. The engagement of brush 124 with surface 14 may be controlled by an adjustable down stop (not shown). This may be made in any one of several conventional ways. Commonly such a stop is a heavy screw bearing against a lug welded to cross shaft 130. A knob on the opposite end of the screw will be accessible to the driver. By turning the knob, the driver or operator can set the brush height for a desired floor contact, or pattern, and can re-set it when needed as the brush wears. Brush 124 is rotated by a hydraulic motor. This motor is supplied by hoses 136. The opposite brush arm 126 (not shown) carries an idler bearing assembly which rotatably supports the opposite end of brush 124. The sweeper 110 also includes a planar side sweep brush 610 (shown in FIG. 6) which is used to sweep debris away from a desired side of the sweeping machine. The side sweep brush 610 places debris or fines in front of the cylindrical brush 124 so that it can be swept and placed into the hopper 168 of the sweeping machine. The side sweep brush 610 can also be positioned to increase the effective sweep width of the sweeping machine beyond the path of the cylindrical sweeping brush 124.

Figure 2:
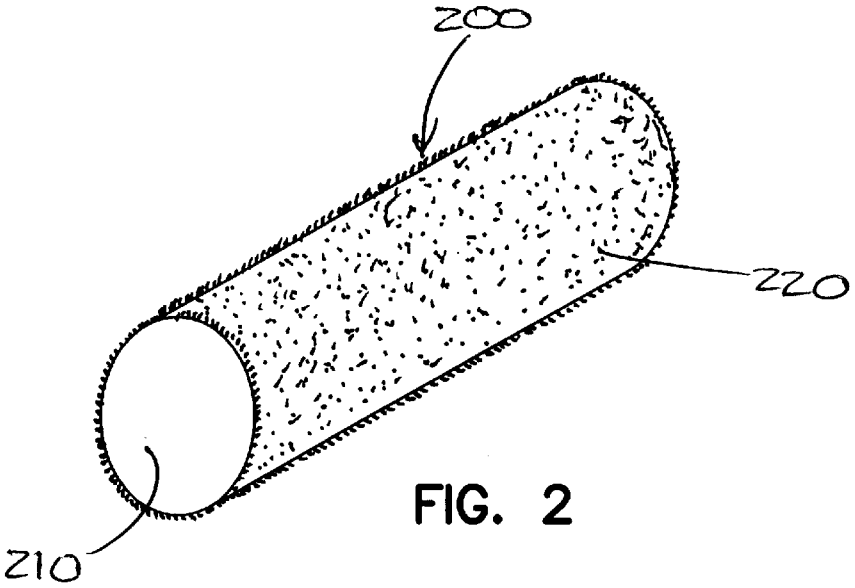
FIG. 2 is a front view of a full fill type of cylindrical brush for a sweeping machine.

FIGS. 2–5 are front views of conventional brushes that have been used on sweeping machines 110. The brush 200 shown in FIG. 2 has been removed from the sweeping machine 110 so that the pattern can be easily viewed. The brush 200 is a cylindrical sweeping brush and further comprises a core or brush tube 210. The core 210 is a member to which sweeping material 220, such as tufts of bristles, can be attached. The core or brush tube 210 is also capable of being rotated. The core of any of the brushes described, could be a tube, a hollow cylinder, a solid cylinder, entwined metal members or the like. It should be noted here that brush 200 shown in FIG. 2 is populated by bristles or sweeping material with full-length bristles. Sweeping fill material 220, such as as bristles, can be made of polypropylene, nylon, polyester, or other synthetics. The brush fill material 220 can also be made of brush wire, or fill materials of a plant or animal origin. The cross sectional size and shape and the length of the bristles can also be varied to tailor the cylindrical brush 200 for a particular purpose.

In a full fill type brush 200 the bristles or other sweeping fill material 220 are closely packed together or in a highly dense configuration. The full fill type brush 200 has no discernable pattern. The bristles or other sweeping material 220 of a full fill brush 200 are so closely packed that they can be placed in almost any type of pattern to form a full fill type brush. The full fill brush presents a solid mass of bristles or other sweeping material. Full fill type brushes 200 are effective in removing relatively thin layers of fine material from surfaces being swept.

Figure 3:
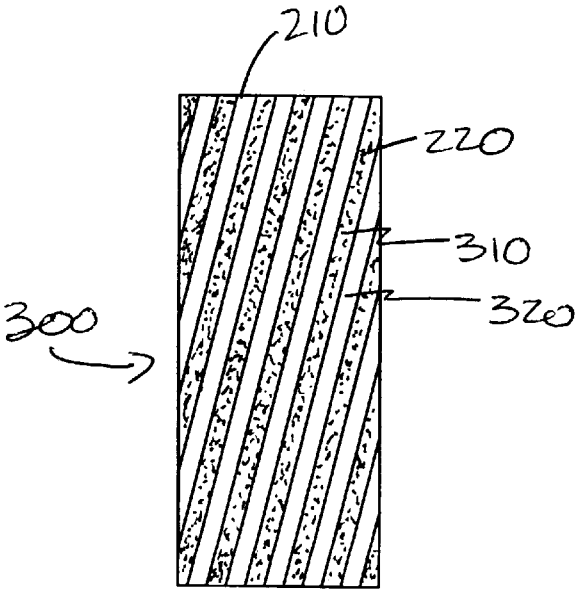
FIG. 3 is a front view of a spiral cylindrical brush for the sweeping machine.

Now turning to FIG. 3, we see another conventional brush which is a spiral type cylindrical brush 300. The bristles or sweeping fill material 220 is placed in spiral pattern along the surface of the core or brush tube 210. The spiral pattern has a number of spiral rows 310 of tufts of brush fill material 220 with alternating spiral spaces 320 between the spiral rows of sweeping material. When the bristles and spaces are in a spiral pattern, the amount of bristle or brush material in contact with the surface being swept is substantially constant as the brush rotates so as to minimize the amount of brush bounce. In other words, at any rotational position of the brush, there is always some brush fill material in contact with the surface being swept to support the brush as it rotates. When the sweeping fill material 220 is in a spiral pattern, debris or fines may travel along the length of the brush 300. The spiral rows 310 of the brush material 220 and the spiral spaces 320 in the pattern act like an auger that may move the debris or fines in one direction along the surface of the brush 300.

Figure 4:
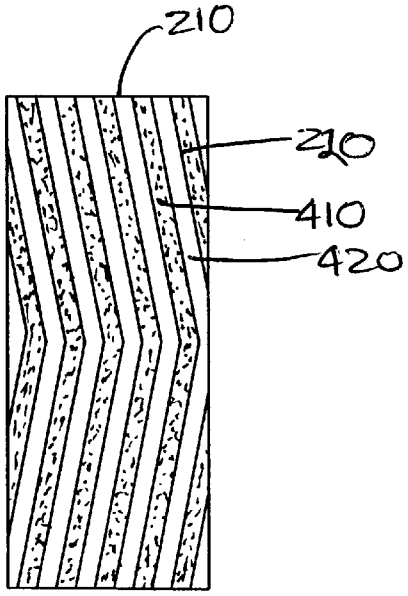
FIG. 4 is a front view of a cylindrical brush having a herringbone pattern.
Figure 5:
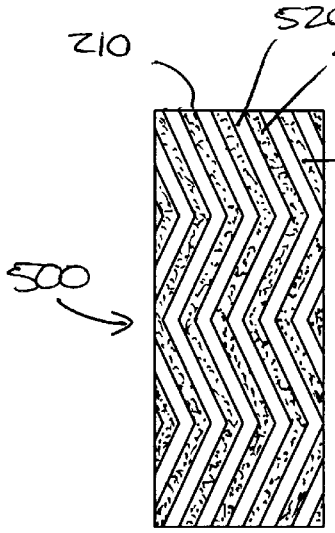
FIG. 5 is a front view of a cylindrical brush for the sweeping machine having a double herringbone pattern.

FIGS. 4 and 5 show brushes that have a herringbone pattern and a double herringbone pattern, respectively. Brush 400 has brush fill material 220 attached to a brush tube or core 210 to form rows 410 in a herringbone pattern. The pattern also features spaces 420 between rows which are also in a herringbone pattern. Each row 410 can be made of a one or more rows of sweeping fill material 220. In other words, two rows could be packed closely together to form a thicker herringbone pattern row 410. The herringbone pattern can also be thought of as chevron pattern or a "V"-shape pattern. The pattern that the row 410 makes is characterized in that it has a first spiral in one direction attached to a second spiral in a second direction. The first direction may be a counterclockwise spiral like a right hand thread. The second direction may be a clockwise spiral like a left hand thread. The herringbone pattern is characterized in that there are an equal number of spiral sections of the brush in a first direction and an equal number of spirals on the brush in a second direction.

As shown in FIG. 4, the brush 400 has one section of the brush 400 or one end, which has a spiral in a first direction and the other end of the brush has a second spiral in a second direction. The herringbone pattern is advantageous in that when the brush 400 is rotated in a particular direction, the debris or fines will be augured in toward the center of the brush 400. Herringbone patterns are used to prevent the transport of debris or fines or material beings swept along the entire length of the brush 400. Fines or materials being swept can be transferred or moved across the entire length of the spiral brush. The herringbone pattern acts to break up this transfer movement of debris or fines. The problem with the herringbone brush is that a regular maintenance item for most brushes is that they must be flipped end-to-end on a sweeper 110 periodically to re-orientate the brush fill material. The end result is that the force on the brush fill material is in the opposite direction after the brush has been flipped. This prevents the brush fill material from taking a set in one direction. With a herringbone brush 400 when the brush is flipped end-to-end, the direction which the debris or fines is augured is changed so that the debris and fines are augured out toward the ends of the brush 400.

FIG. 5 shows a double herringbone brush 500. In a double herringbone brush 500, the row 510 and brush material 220 is in a pattern with two herringbones connected end-to-end. The herringbones can also be thought of as "V's" or chevrons. Again the brush 500 can be broken into four sections. In the first and second sections the spiral is in a first direction. In the third and fourth sections of the brush 500, the spiral is in a second direction. Just like the brush 400, the brush 500 has the same number of spirals in the first direction as in the second direction. The problems associated with the single herringbone brush 400 are the same as those associated with the double herringbone brush 500. One of the problems is that when the brush is rotated in one orientation, debris and fines are augured in toward the center of the brush, but when the brush is flipped end-to-end to re-orientate the brush fill material, the debris and fines are augured in the opposite direction toward the ends of the brush 500.

Figure 6:
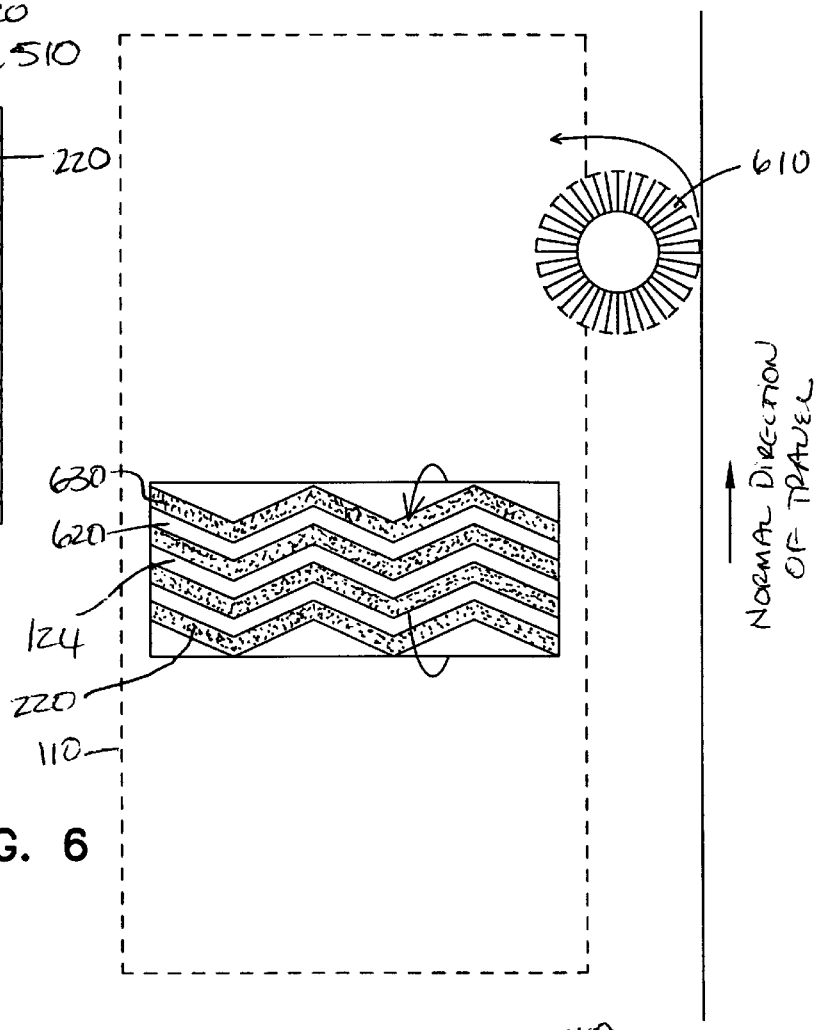
FIG. 6 is a top schematic view of a cylindrical brush having a pattern with a herringbone plus an added spiral pattern and attached the sweeping machine.

FIG. 6 shows a top view of a sweeping machine 110 that includes the inventive brush 124 and also has a side sweep brush 610. The outline of the sweeping machine 110 is shown in phantom. The side sweep brush 610 removes debris from a desired or selected side of the sweeping machine 110 and places it in front of the brush so that it can be effectively swept up by the main brush 124. The side sweep brush also extends the sweeping path of the sweeping machine 110. The brush 124 includes a brush tube or core 210 which has bristles or other sweeping material 220 attached to the brush tube in a pattern which forms rows 630 of sweeping materials and spaces 620 between the rows of sweeping material. The rows 630 have bristles or sweeping material 220 formed in a zig zag pattern. The zig zag pattern has N spirals in a first direction and N+1 spirals in a second direction. The spirals in the second direction are located on the ends of the core or the brush tube 210 in each row 630. The pattern of the brush 600 can also be thought of as a double herringbone pattern with an additional spiral. The pattern can also be thought of as having a series of full chevrons or "V's" with an additional half of a chevron or half of a "V". The pattern is characterized in that the brush may be divided into sections in which there are N+1sections having a spiral and a first direction and N sections having a spiral in a second direction. The cylindrical sweeping brush 600 has two ends. One end is situated near a preferred, desired or selected side of a sweeping machine 110. Although not always true, in most instances the side sweep brush 610 is positioned on the preferred side of the sweeping machine.

The zig zag rows of spiral 630 are oriented so that when the brush rotates the lead tufts at the desired side of the sweeping machine 110 will tend to auger debris inward or toward the center of the brush. The advantage of this brush is that when it is flipped end-to-end as part of maintenance of the machine, the auguring effect at the desired or preferred end of the brush will continue to move debris inward. In other words, when the brush 600 is flipped, the auguring effect continues to move debris in a direction from a desired side of the sweeping machine 110 toward the center of the brush. This is advantageous in that in some applications much of the debris may be at the desired side of a sweeping machine 110. For example, in a street sweeper, much of the debris is at the curb side of the sweeping machine 110 during normal sweeping conditions. As a result, there is less possibility for trailing or leaving a trail of fines such as sand, at the desired side of the sweeping machine.

Figure 7:
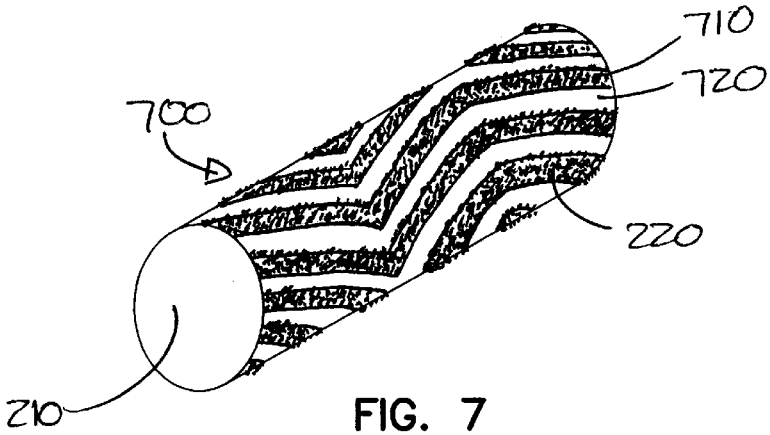
FIG. 7 is a front view of a cylindrical brush for the sweeping machine having a pattern with a herringbone plus an added spiral pattern.

FIG. 7 shows a brush 700 which includes rows of 710 sweeping fill material 220 which are formed in a zig zag pattern. Each row 710 includes a spiral section. The first and third spiral sections are in the same or in a first direction and are at the ends of the brush. The second spiral section is attached to the first and third spiral section and is in a different direction or second direction. The brush, therefore has N+1 sections in a first spiral direction and N spirals in a second direction. In the case of the brush shown in FIG. 7, N=1. The brush 700 can also be thought of as a single herringbone having an added spiral; or thought of as a single chevron plus half a chevron; or thought of as a single "V" plus half of another "V". It should be noted that the pattern on the brush is orientated so that when it rotates the brush augers inward from a desired side of the sweeping machine. It should be noted that N can be any number. By increasing the number N, it merely increases the number of chevrons or v's formed in the row 710 of the brush 700. Each row 710 is spaced apart from an adjacent row. The spaces carry the reference numeral 720.

Advantageously, since the debris augured inward from the desired side of the sweeping machine 110, the debris is restricted in its travel along the length of the cylindrical body of the brush. The brush also moves the debris from the desired side of the sweeping machine for effective sweeping with minimized trailing or debris escaping at the one end of the cylindrical brush. The brush can also be flipped end-to-end and the end of the brush located at the desired or selected side of the sweeping machine will still auger debris in toward the center of the brush. An additional advantage is that a sweeping machine 110 equipped with the cylindrical brush mentioned above picks up or sweeps all types of debris.

As mentioned above and as seen in the several preferred embodiments described herein, there are many different types of brush fill materials. In addition, there are many different brush tube types. Brush tubes can be made of wood, paper, plastics, or other materials. In addition, brush tubes can be made of composites of several materials. The tufts or grouping of individual bristles can be attached to the tubes in a number of ways as well. For example, the tufts may be stapled to the brush tube or may be constructed of strip brushes. It should be noted that the invention described herein can be made using any type of brush fill material, any type of tube and using any way of attaching the bristles to the tube to form a brush in which the sweeping material forms a plurality of first regions of sweeping material and a plurality of second regions devoid of sweeping material.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A sweeping machine for picking up debris from a surface, said sweeping machine comprising:

a frame having a first brush attachment element and having a second brush attachment element;

wheels attached to said frame, said wheels for supporting said frame over said surface;

a cylindrical brush rotatably attached to said frame at the first brush attachment element and at the second brush attachment element, said cylindrical brush further comprising:

a cylindrical body having first and second ends; and sweeping material attached to said cylindrical body to form a brush having a plurality of spaced apart rows, said rows including a herringbone pattern having a spiral in a first direction attached to a spiral in a second direction, one of said first direction or second direction spirals positioned on the first end of the cylindrical body, said row further comprising an additional spiral attached to the second end of the cylindrical body, said additional spiral rotating in substantially the same direction as the spiral positioned on the first end of the cylindrical body, the cylindrical body rotating so that the sweeping material moves debris toward the middle of the cylindrical body from one of the first and second ends of the cylindrical body in a first rotational orientation, and moves debris toward the middle of the cylindrical body from one of the first and second ends of the cylindrical body in a second rotational orientation, said first rotational orientation differing from the second rotational orientation in that the brush is flipped end to end from the first rotational orientation to the second rotational orientation; and a mechanism for rotating said cylindrical brush.

2. The sweeping machine for picking up debris from a surface of claim 1 wherein the first end of the cylindrical brush can be rotatably attached to one of the first brush attachment element and the second brush attachment element and wherein the second end of the cylindrical brush can be rotatably attached to the other of the first brush attachment element and the second brush attachment element on the frame.

3. The sweeping machine for picking up debris from a surface of claim 2 wherein debris is augured away from a side of the frame of the sweeping machine before and after the brush is flipped end-to-end with respect to said frame.

4. The sweeping machine for picking up debris from a surface of claim 1 further comprising an arm attached to said cylindrical brush for controlling the amount of force applied between the cylindrical brush and the surface.

5. A method for sweeping with a brush, said brush including a cylindrical body having first and second ends, and sweeping material attached to said cylindrical body to form a brush having a plurality of spaced apart rows, said rows including a herringbone pattern having a spiral in a first direction attached to a spiral in a second direction, one of said first direction or second direction spirals positioned on the first end of the cylindrical body, said row further comprising an additional spiral attached to the second end of the cylindrical body, said additional spiral rotating in substantially the same direction as the spiral positioned on the first end of the cylindrical body, said method comprising the steps of:

rotating the cylindrical body of the brush in a selected direction so that the sweeping material moves debris toward the middle of the cylindrical body from one of the first and second ends of the cylindrical body;

flipping the cylindrical body end-to-end; and rotating the cylindrical body of the brush in the selected direction, said sweeping material moving debris toward the middle of the cylindrical body from one of the first and second ends of the cylindrical body.

* * * * *